United States Patent [19]

English et al.

[11] Patent Number: 4,598,342

[45] Date of Patent: Jul. 1, 1986

[54] LOW WATTAGE DOUBLE FILAMENT TUNGSTEN-HALOGEN LAMP

[75] Inventors: George J. English, Reading; Peter R. Gagnon, Georgetown; Stephen J. Leadvaro, Salem, all of Mass.

[73] Assignee: GTE Products Corporation, Stamford, Conn.

[21] Appl. No.: 629,132

[22] Filed: Jul. 9, 1984

[51] Int. Cl.[4] ..... F21M 3/20; H01J 1/88

[52] U.S. Cl. ..... 362/213; 313/273; 362/277

[58] Field of Search ..... 362/211, 212, 213, 277; 313/113, 271, 272, 273, 279, 344, 569, 579

[56] References Cited

U.S. PATENT DOCUMENTS 2,227,294 12/1940 Brody ..... 313/569
2,947,851 8/1960 Lozeau ..... 362/211 X
3,579,021 5/1971 Kimball .
3,665,240 5/1972 Archer .
4,414,484 11/1983 Notelteirs et al. .
4,463,277 7/1984 DeCaro ..... 313/113 X

FOREIGN PATENT DOCUMENTS 210105 1/1924 United Kingdom ..... 362/213

*Primary Examiner*—Tony M. Argenbright
*Attorney, Agent, or Firm*—Jose W. Jimenez

[57] ABSTRACT

A low wattage tungsten-halogen lamp with an improved filament construction comprising a pair of selectively activated filaments, each having a plurality of coil turns, being intercoupled by a relatively short intermediate member. Preferably, both of the filaments and the intermediate member are formed from a single wire. The spacing between turns of each filament is greater about the central portion of the filament than at the opposed end portions thereof, thereby enhancing visible radiation. Xenon gas, at a pressure of fifteen atmospheres, is preferably used as the inert gas fill for the lamp due to its low thermal conductivity.

32 Claims, 7 Drawing Figures

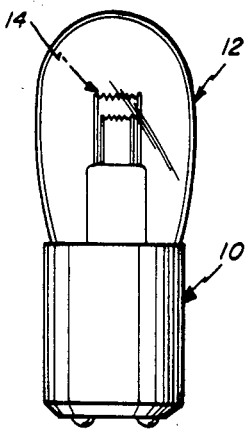
PRIOR ART
Fig. 1
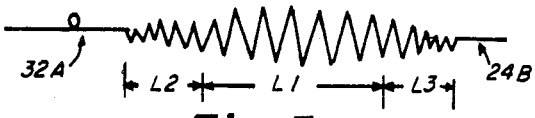
Fig. 5
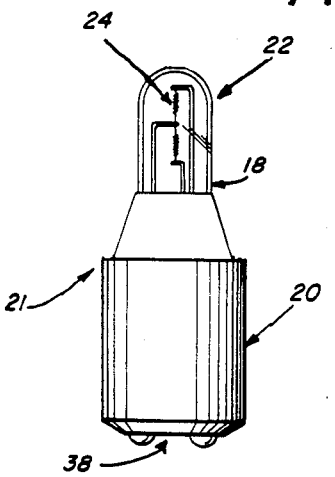
Fig. 2A
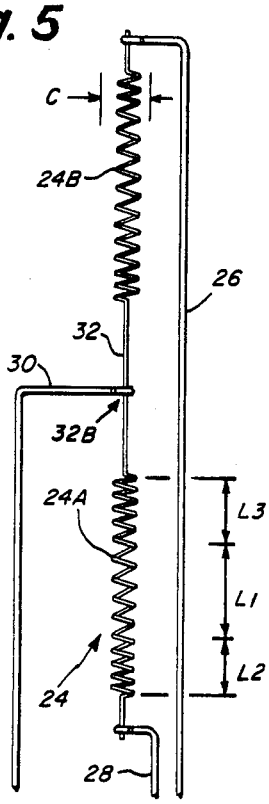
Fig. 3
Fig. 4A
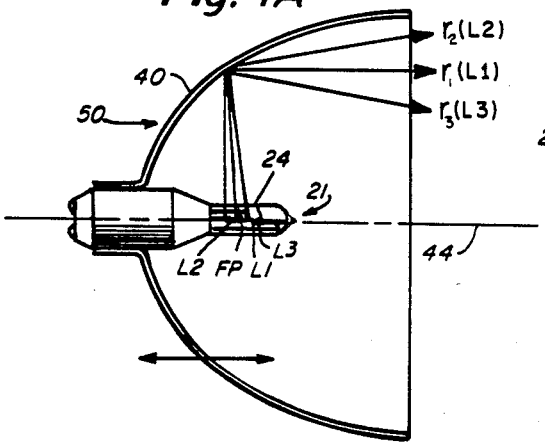
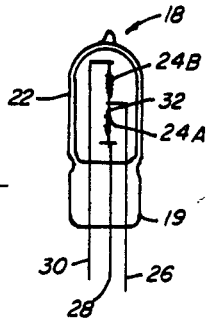
Fig 2B
Fig. 4B
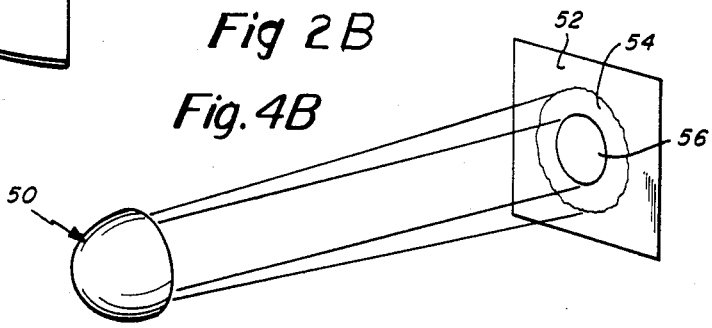

LOW WATTAGE DOUBLE FILAMENT TUNGSTEN-HALOGEN LAMP

CROSS-REFERENCE TO COPENDING APPLICATIONS

Reference is made to co-pending applications, having Ser. Nos. 629,133, now U.S. Pat. No. 4,536,831 and 629,131, respectively, filed concurrently herewith and assigned to the assignee of this application, which contain related subject matter.

TECHNICAL FIELD

The present invention relates in general to a low wattage, double filament tungsten halogen lamp having a higher efficacy than present state of the art lamps at equivalent life and wattage conditions. More particularly, the present invention relates to a low wattage tungsten halogen lamp having a high luminance coil at low wattage, particularly in comparison with present state of the art lamps.

BACKGROUND

One known example of an incandescent lamp which the present invention is designed to replace, includes a base, a bulb, and a pair of tungsten filaments of the cross axis, coil type.

There have been difficulties in the past in providing a tungsten-halogen lamp capable of providing sufficient luminance when utilizing a low wattage coil configuration (such as one of less than fifteen watts). It has been observed that the coil temperature, which is primarily instrumental in governing luminance, falls off rapidly from the central portion to the opposed end portions of the filament. This temperature variation is due to the adjacent coils heating each other in the central portion, while the two opposed end portions are heated primarily on the side closest to the central portion, the temperature tapering off as the ends are reached. In low wattage filaments, the number of single coil turns is relatively small and thus the percentage of coil turns that is radiating efficiently in the visible region is relatively low.

DISCLOSURE OF THE INVENTION

It is an object of the present invention to provide an improved low wattage, double filament tungsten-halogen lamp having better luminance in comparison with present state of the art lamps of substantially equivalent life and wattage.

Another object of the present invention is to provide an improved low wattage, double filament tungsten-halogen lamp in which luminance is enhanced by maintaining filament temperature uniform therealong and by further using a high pressure inert gas fill as a thermal isolator.

A further object of the present invention is to provide a low wattage lamp which has a higher efficacy than present state of the art tungsten-halogen lamps of comparable life.

Still another object of the present invention is to provide a tungsten-halogen lamp having a higher average luminance in comparison with presently existing lamps, thus producing a light source with a lower color temperature variation across the coil, the effect of which is to produce a more uniform beam of light when used in an optical system.

In accordance with one aspect of the invention, there is provided a lamp member for use in a lighting unit. The lamp member includes a tungsten-halogen capsule with a pressed sealed aend that forms a wedge base portion. An inert gas fill and a halogen are disposed within the capsule's envelope. The lamp member further includes a filament structure axially located within the envelope and supported by the wedge base portion. The axial filament structure includes at least two coiled filament members located in an end to end manner and formed from a single wire intercoupled by an intermediate member. Each of the filament members is capable of operating independently from the other and each includes a central portion and two opposed end portions. The coil spacing or pitch of the central portion is greater than the coil spacing at the opposed end portions. The lamp member further includes means for supporting and selectively activating each of the filament members, the support and selective activation means being disposed within the envelope and supported by the wedge base portion.

In accordance with another aspect of the invention, there is provided a lamp unit including a reflector and a lamp member. The reflector defines an open end and has an axis that extends through the focal point of the reflector and is perpendicular to the open end. The lamp member is positioned within the reflector along the axis and includes a base shell member and a tungsten-halogen capsule having a wedge base portion secured to the base shell member. The capsule includes an envelope with an inert gas fill and a halogen disposed within. A filament structure is axially located within the envelope and is supported by the wedge base portion. The filament structure includes at least two coiled filament members located in an end to end manner and formed from a single wire intercoupled by an intermediate member. Each of the filament members is capable of operating independently from the other and each include a central portion and two opposed end portions. The coil spacing or pitch of the central portion is greater than the coil spacing at the opposed end portions. The lamp member further includes means for supporting and selectively activating each of the filament members, the support and selective activation means being disposed within the envelope and supported by the wedge base portion.

DESCRIPTION OF THE DRAWINGS

FIG. 1 illustrates one example of a prior art incandescent lamp;

FIG. 2A is a side elevation view of the improved tungsten-halogen lamp in accordance with the present invention;

FIG. 2B shows the tungsten-halogen capsule utilizing the filament structure in accordance with the teachings of this invention;

FIG. 3 is an enlarged view of the double filament arrangement in accordance with the present invention;

FIGS. 4A and 4B depict luminance patterns generated from a lamp member positioned within a reflector; and FIG. 5 shows an enlarged view of a filament member with a variable coil diameter.

BEST MODE FOR CARRYING OUT THE INVENTION

For a better understanding of the present invention together with other and further objects, advantages and capabilities thereof, reference is made to the following disclosure and appended claims in connection with the above described drawings.

The lamp of the present invention is characterized by a higher efficacy in comparison with present state of the art lamps operating at equivalent life and wattage conditions. In comparing the lamp of the present invention with constructions in the prior art, such as illustrated in FIG. 1, there is provided both a higher than average luminance coil at low wattage and also a higher than normal capsule efficacy at low wattage. The improved lamp of the present invention is a double filament lamp constructed in a manner to substantially enhance visible radiation by varying the pitch of the coil turns along the length of each filament.

The improved luminance that is provided by the lamp of this invention has at least two optical advantages. First, the lamp has a higher efficacy than a high pressure incandescent lamp or known present state of the art tungsten-halogen lamps of comparable life and wattage. Second, the higher average luminance produces a source with a lower color temperature variation across the filament, which when inserted into an optical system, produces a more uniform white beam of light With reference to the drawings, there is shown, particularly in FIG. 2A, a preferred embodiment of the low wattage double filament tungsten-halogen lamp of the present invention. The lamp member 21 comprises a base shell member 20 that supports a tungsten-halogen lamp capsule 18, that is illustrated in FIG. 2B, which includes a first envelope or bulb 22. The capsule 18 further includes an inert gas fill and a halogen disposed therein. A filament structure 24 (see FIG. 3) is axially located within the first envelope 22 and is supported by wedge base portion 19. The first envelope 22 has a press-seal end forming wedge base portion 19, located within the base shell member 20, through which the leads 26, 28 and 30 of FIG. 2B extend. Leads 26, 28 and 30 connect to base sheli member 20 and to base contacts 38, associated with the base shell member 20, in a conventional manner.

The lamp of the present invention is meant to replace presently utilized conventional incandescent lamps (i.e., FIG. 1) used in a low wattage lamp fixture. However, the coil size and orientation of this replacement lamp is substantially different from that of known lamps which in turn may result in a different lighting distribution. To adjust for this, the envelope 22 of capsule 18 can be sandblasted or otherwise treated to provide a diffused surface. In accordance with the present invention, improved operation is provided by the use of an axial filament structure 24 in the capsule 18, or in conjunction with the aforementioned diffused surface. The aforementioned combination provides a higher beam intensity and wider main beam coverage than with known incandescent lamps of comparable wattage.

In FIG. 3, leads 26, 28, and 30 are connected to the filament structure 24 and serve to provide support therefor. The filament structure 24 includes coiled filament members 24A and 24B, each located in an end to end manner. Support lead 26 is conductively coupled to the top of coiled filament member 24B and support lead 28 is conductively coupled to the bottom of coiled filament member 24A. Filament members 24A and 24B, in one embodiment, are electrically connected in series. Support lead 30 is connected to an intermediate member 32 that intercouples coiled filament members 24A and 24B. Intermediate member 32 can be a straight section (32B, FIG. 3) or a single coiled turn (32A, FIG. 5) and assists in balancing the resistance between the filament members.

The three lead configuration shown in FIGS. 2B and 3 allows the 4-way operation of lamp member 21. A voltage across leads 28 and 30 will activate filament member 24A. Filament member 24B is activated when leads 26 and 30 are used. Filament members 24A and 24B are activated in series when leads 26 and 28 are used. The filament members are activated and operate in parallel when all three leads are used. Selective activation can be accomplished through the use of base contacts 38 and base shell member 19.

The filament members 24A and 24B and the intermediate member 32 are all formed from a single wire. Generally, the length of the intermediate member 32 is about two-thirds of the length of either of the filament members. The length of the intermediate member 32 is from about 1.00 to about 1.50 millimeters (mm.). Each of the filament members 24A and 24B have a length of about 1.00 to 1.50 mm., and each have from about ten to twenty coil turns. The ratio of the TPI (turns per inch) of the opposed end portions to the TPI of the central portion of each of the filament members is about 1.45 or greater. The intermediate member 32 aids in the ease of fabrication of the filament structure and also aids in the production of filaments with more uniform life and more desirable light source characteristics. The filament configuration of FIG. 3 may be accurately and repeatedly reproduced on a conventional coil winding machine. The assembly as depicted in FIG. 3, for example, readily lends itself to hard glass halogen lamp manufacturing techniques.

In order to provide for sufficient life of the lamp, it is desired to have nearly equal coil resistance in both filament members 24A and 24B. This is more readily accomplished, as stated above, by winding both filament members from one continuous piece of wire. This is advantageous for at least two reasons. First, any resistance parameters that relate to the wire itself will be uniform throughout each filament member. Second, both of the filament members have a common support lead 30, as illustrated in FIG. 3, which equalizes the contact resistance between filament members.

FIGS. 3 and 5 illustrate acceptable alternative configurations for coiled filament members 24A and 24B of the invention, each filament member having a plurality of coils with variable pitch. The pitch of the coils of the luminance central portion, L1, of each filament member is the greatest in comparison with the pitch of the coils at the two opposed end portions, L2 and L3, of each filament. This variable pitch coil arrangement for the filaments provides for an improvement in luminance by providing uniformity in temperature along each filament. The previously hotter central portion is now heated less because of the more widely space turns, while the end portions still maintain a high temperature, due to the closer turns. This has the overall net effect of equalizing temperature and enhancing luminance.

Each filament member is also defined by its coil diameter, which is illustrated by the dimension C in FIG. 3. In FIG. 3, the coil diameter of the filament member 24B is substantially uniform along the length thereof. The configuration of the filament members can also be altered by varying the coil diameter along the length of the filament members. FIG. 5 illustrates one example where the coil diameter is the greatest at the central portion and progressively decreases (tapers) as the two opposed end portions are reached. This will result in a substantially tapered configuration for each of the two filament members.

With reference to the gas fill of the lamp, the preferred fill is an inert gas with a high molecular weight. Xenon gas is preferred due to its low thermal conductivity. The use of xenon gas assists in maintaining the standby or unactivated filament member at a cooler temperature, thus protecting it from a halogen attack, while serving to enhance the lamp's efficacy. The xenon gas is expected to operate at pressures exceeding two atmosphers, preferably fifteen atmospheres. In the present invention the filament member of lamp 21, having non-uniform coil spacing, operates in cooperation with the quasistatic Langmuir gas sheath created by the xenon gas operating within a sealed envelope.

FIGS. 4A and 4B depict luminance patterns generated from a lamp unit 50. FIG. 4A schematically illustrates an adjustable reflector 40 with an open end and lamp member 21 positioned within reflector 40 along the axis 44. The use of reflector 40 with lamp member 21 allows the movement of the focal point of the reflector, Fp, of the reflector over the filament member (e.g., 24A) that is presently activated. Upon failure of one of the filament members, Fp can be positioned over the other operable filament member (e.g., 24B).

FIG. 4A further illustrates a fan of rays $r_1$, $r_2$, and $r_3$ that originate from filament member 24A and that are about equal in color temperature. The average luminance of the opposed ends L2 and L3 of filament 24A are approximately equal and greater than the average luminance at the central portion L1. The average luminance from a portion of the filament member depends on the coil temperature, coil spacing and intrareflections within the filament member's structure. As previously stated, the coil configuration of filament members 24A and 24B have the overall net effect of equalizing temperature throughout the filament member and enhancing luminance. Constant readjustment or Fp over either of the filament members in FIG. 4A, will not be necessary since the average luminance output along the length will be uniform.

The otpical disadvantages of using a light source in reflector 40 with a filament having uniform coil spacing is illustrated with the help of FIGS. 4A and 4B. Such a light source has non-uniform luminance along the length of the filament due to the majority of the intrareflections occurring between coil turns and the high coil temperature occurring in the central portion of the filament. The ends of the filament are generally cooler because of heat sinking effects due to filament supports and the lack of intrareflections of rays. The color temperature of rays $r_2$ and $r_3$, using this light source, are much lower than the color temperature of ray $r_1$. This non-uniformity in the color gradience, due to the coil luminance fall-off at the ends of the filament, is illustrated schematically in FIG. 4B. FIG. 4B shows lamp unit 50 with the aforementioned light source and screen 52. The illumination region 54 illustrates the illumination region due to low luminance of the low intensity portion of the beam (i.e., end portions of the filament). The illumination area 56 illustrates illumination due to high luminance which is at the high intensity of the beam (i.e., central portion of the filament). The overall net result here is a non-uniform beam of light with less intensity.

EXAMPLE

In accordance with one embodiment of the present invention, a four-watt lamp operating on a voltage of 3.6 volts with a current draw of 1.1 amp was produced. The lamp possessed an efficacy of 14.5 lumens per watt and was rated for 300 hours of operation. The gas fill was xenon, at a pressure of fifteen atmospheres, and the color temperature was about 3150° K. The lamp member included a first envelope, made of hardglass, having an axial filament structure with an overall length of 4.05 mm. and a coil diameter of 0.25 mm. The two filament members of the filament structure each possessed about eleven coil turns while the intermediate member had a length under 1 mm. The TPI for the opposed end portions of the filament members was about 210, while the central portion possessed about 143 turns per inch. The ratio of the TPI of the end portions to the TPI of the central portion was about 1.47.

While there have been shown and described what are at present considered the preferred embodiments of the invention, it will be obvious to those skilled in the art that various changes and modifications may be made therein without departing from the scope of the invention as defined by the appended claims.

What is claimed is:

1. A lamp member comprising:

a tungsten-halogen capsule having a pressed sealed end forming a wedge base portion, said capsule including an envelope with an inert gas fill and a halogen disposed therein;

a filament structure axially located within said envelope and supported by said wedge base portion, said axial filament structure including at least two coiled filament members located in an end to end manner and formed from a single wire intercoupled by an intermediate member, each of said filament members capable of operating independently from the other and each including a central portion and two opposed end portions, the coil spacing of said central portion being greater than the coil spacing at said opposed end portions; and means for supporting and selectively activating each of said filament members, said support and selective activation means being disposed within said envelope and supported by said wedge base portion.

2. The lamp member according to claim 1 wherein said coiled filament members are electrically connected in series.

3. The lamp member according to claim 2 wherein said support and selective activation means comprises a plurality of support leads extending from said wedge base portion.

4. The lamp member according to claim 3 wherein said plurality of support leads includes a first lead connected to one end of said axial filament structure and a second lead connected to said intermediate member of said filament structure, said filament member, bounded by said first and second leads, can be selectively activated.

5. The lamp member according to claim 4 wherein said plurality of support leads further includes a third lead connected to an opposite end of said filament structure from said first end, said filament member, bounded by said second and third leads, can be selectively activated.

6. The lamp member according to claim 5 wherein said first and third leads can be used to activate both of said filament members in series.

7. The lamp member according to claim 5 wherein said first, second and third leads can be used to activate both of said filament members in parallel.

8. The lamp member according to claim 3 wherein said lamp member further comprises a base shell member having a plurality of base contacts formed thereon, said base shell member disposed about said wedge base portion, said plurality of leads extending from said wedge base portion and connected to said base contacts and said base shell member.

9. The lamp member according to claim 1 wherein said fill is of a high molecular weight inert gas at a pressure in excess of about two atmospheres, said fill having low thermal conductivity.

10. The lamp member according to claim 9 wherein said fill of inert gas is at a pressure of about five to about twenty atmospheres.

11. The lamp member according to claim 10 wherein said fill of inert gas comprises xenon at a pressure of about fifteen atmospheres.

12. The lamp member according to claim 1 wherein said intermediate member of said filament structure is of substantially coiled configuration.

13. The lamp member according to claim 1 wherein said intermediate member of said filament structure is of substantially linear configuration.

14. The lamp member according to claim 13 wherein the length of said intermediate member is about two-thirds of the length of either of said filament members.

15. The lamp member according to claim 14 wherein the length of said intermediate member is from about 1.00 to about 1.50 millimeters.

16. The lamp member according to claim 1 wherein each of said filament members has a length of about 1.50 millimeters.

17. The lamp member according to claim 1 wherein the coil diameter of each of said filament members is substantially uniform along the length thereof.

18. The lamp member according to claim 17 wherein said coil diameter is about 0.25 millimeters.

19. The lamp member according to claim 1 wherein each of said filament members has a variable coil diameter, said variable coil diameter being the greatest at said central portion and progressively decreasing towards said opposed end portions, each of said filament members possessing a substantially tapered configuration from said central to said end portions.

20. The lamp member according to claim 1 wherein each of said filament members includes from about ten to about twenty coiled turns.

21. The lamp member according to claim 20 wherein the ratio of the turns per inch of said opposed end portions to the turns per inch of said central portion of each of said filament members is about 1.45 or greater.

22. The lamp member according to claim 1 wherein said color temperature is on the order of about 3150° K.

23. The lamp member according to claim 22 wherein the lamp efficacy is on the order of about 14.5 lumens per watt.

24. The lamp member according to claim 1 wherein said envelope is of a thin hardglass.

25. A lamp unit comprising:

a reflector defining an open end and having an axis that extends through the focal point thereof, said axis perpendicular to said open end;

a lamp member positioned within said reflector along said axis, said lamp member including a base shell member, a tungsten-halogen capsule having a wedge base portion secured to said base shell member, said capsule including an envelope with an inert gas fill and a halogen disposed within;

a filament axially located within said envelope and supported by said wedge base portion, said axial filament structure including at least two coiled filament members located in an end to end manner and formed from a single wire intercoupled by an intermediate member, each of said filament members capable of operating independently from the other and each including a central portion and two opposed end portions, the coil spacing of said central portion being greater than the coil spacing at said opposed end portions; and means for supporting and selectively activating each of said filament members, said support and selective activation means being disposed within said envelope and supported by said wedge base portion.

26. The lamp unit according to claim 25 wherein said coiled filament members are electrically connected in series.

27. The lamp unit according to claim 26 wherein said reflector is adjustable such that the focal point thereof can be positioned along the length of either of said filament members of said filament structure.

28. The lamp unit according to claim 27 wherein said support and selective activation means comprises a plurality of support leads extending from said wedge base portion and secured to said base shell member.

29. The lamp unit according to claim 28 wherein said plurality of support leads includes at least a first lead connected to one end of said filament structure and a second lead connected to said intermediate member of said filament structure, said filament member, bounded by first and second leads, can be selectively activated.

30. The lamp unit according to claim 29 wherein said plurality of leads further includes a third lead connected to an opposite end of said filament structure from said first end, said filament member, bounded by said second and third leads, can be selectively activated.

31. The lamp unit according to claim 25 wherein said fill is of a high molecular weight inert gas at a pressure in excess of about two atmospheres, said fill having low thermal conductivity.

32. The lamp unit according to claim 31 wherein said fill of inert gas comprises xenon at a pressure of about fifteen atmospheres.

* * * * *